US005538673A

United States Patent [19]

Edmonston

[11] Patent Number: 5,538,673

[45] Date of Patent: Jul. 23, 1996

[54] CARBURETOR

[76] Inventor: Michael L. Edmonston, 16547 Neenach Rd., Apple Valley, Calif. 92307

[21] Appl. No.: 395,003

[22] Filed: Feb. 27, 1995

[51] Int. Cl.[6] ..... F02M 9/06

[52] U.S. Cl. ..... 261/44.3; 261/DIG. 38; 251/297

[58] Field of Search ..... 261/44.3, DIG. 38; 251/297

[56] References Cited

U.S. PATENT DOCUMENTS

| | | | |
|---|---|---|---|
| Re. 31,475 | 12/1983 | Edmonston | 261/44.3 |
| 690,112 | 12/1901 | Kull | 251/297 |
| 1,157,363 | 10/1915 | Bloomquist | 261/44.3 |
| 1,333,048 | 3/1920 | Webster | 251/297 |
| 1,516,000 | 11/1924 | Clark | 251/297 |
| 1,633,074 | 6/1927 | De Mott | 251/297 |
| 2,075,458 | 3/1937 | Parker | 251/297 |
| 2,610,024 | 9/1952 | Wirth et al. | 251/297 |
| 3,709,469 | 1/1973 | Edmonston | 261/44.3 |
| 3,985,839 | 10/1976 | Edmonston | 261/44.3 |
| 4,013,741 | 3/1977 | Edmonston | 261/44.3 |
| 4,221,747 | 9/1980 | Edmonston | 261/44.3 |
| 4,442,046 | 4/1984 | Edmonston | 261/44.3 |
| 4,926,059 | 5/1990 | Edmonston | 261/44.3 |
| 4,971,730 | 11/1990 | Edmonston | 261/44.3 |
| 5,295,660 | 3/1994 | Honma | 251/297 |
| 5,342,555 | 8/1994 | Edmonston | 261/44.3 |

*Primary Examiner*—Tim R. Miles
*Attorney, Agent, or Firm*—Lowe, Price, LeBlanc & Becker

[57] ABSTRACT

A carburetor of the slide and metering rod type is characterized by the provision of an adjusting screw assembly which has an audible sound feature resulting in a click every quarter revolution of the carburetor adjusting screw. With this clicking, the carburetor can be precisely adjusted by merely counting the number of clicks in either a clockwise or a counterclockwise rotation.

3 Claims, 3 Drawing Sheets

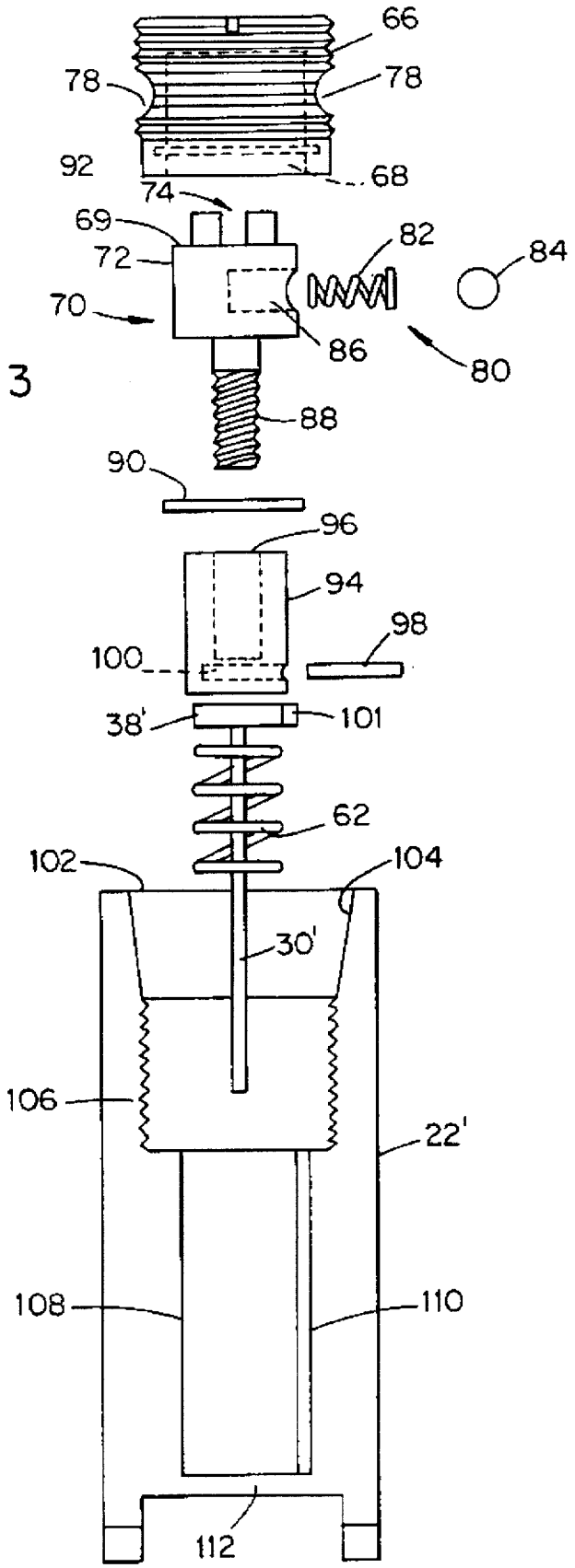
FIG. 3
FIG. 5
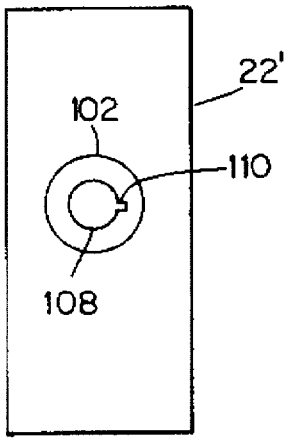

CARBURETOR

FIELD OF THE INVENTION

The present invention is directed to an improved carburetor and, in particular, to a carburetor having an improved carburetor adjustment metering rod assembly.

BACKGROUND ART

Carburetors of the slide and metering rod type are well known in the prior art, as evidenced by the inventor's prior U.S. Pat. Nos. 3,985,839; 4,013,741; 4,442,046; 4,221,747; 4,926,059; 4,971,730; 5,342,555; and U.S. Pat. Reissue No. 31,475. Each of these patents is hereby incorporated in their entirety by reference.

In these types of carburetors, particularly U.S. Pat. No. 4,926,059, the position of the metering rod relative to the slide member can be easily adjusted by rotation of an adjusting screw which can be engaged through an opening in the upper portion of the carburetor housing in alignment therewith. Referring to FIG. 1, this prior art carburetor is generally designated by the reference numeral 10, the carburetor comprising a body 12 having an air inlet end 14, an air outlet end 16 and a centrally located slide supporting portion 18. A cover 20 is provided to fit over the upper portion of the slide support portion 18. A fuel reservoir 21 is secured to the underside of the body beneath the slide supporting portion. Since the operation of this type of carburetor is well known, only the function of the adjusting screw will be described hereinafter.

In these types of carburetors, a throttle slide member 22 is mounted within the slide supporting portion 18 for substantially vertical slidable movement therein. The slide member 22 is actuated in a push pull manner by the control cable 24 and an actuator member 26 to control the air flow from inlet end 14 to the outlet end 16 of the carburetor body 12. The slide member 22 also controls the flow of fuel from the fuel reservoir 21 to the carburetor throat 28 because of the corresponding upward or downward movement of the metering rod 30 secured to the throttle slide member 22.

The metering rod needle 30 is adjustably secured and extends downwardly from the slide member 22 into the central opening 33 of the fuel supply tube 36. The metering rod 30 is provided with an enlarged head portion 38 which is slidably received within the complementary internal bore 40 of the slide member 22.

The position of the metering rod 30 relative to the slide 22 can be easily adjusted by rotation of an o adjusting screw or bolt 42 via the opening 44 which may be kept covered with a plug using the threads 46 therein.

The adjusting screw 42 slidably extends through an opening 48 in a plate 50 fixedly mounted within the bore 40 in the slide member 22. The end of the adjusting screw is provided with an enlarged head 52 which has a recess or the like in its upper end for receiving the end of an adjusting tool such as a screwdriver, wrench or the like.

The lower end of the adjusting screw is threadably o received within a threaded bore 54 in the head portion 38 of the metering rod 30. The head portion 38 of the metering rod is slidably received within the bore 40 in the slide member 22 and is of a size in cross-sectional shape to be complementary to the bore 40 so as to be nonrotatable therein. A coil spring 56 surrounds the adjusting screw 42 and is disposed between the lower surface of the plane member 50 and the head portion 38 to urge the metering rod 30 downwardly to a desired idle position or the like relative to the slide 22. In this manner, rotation of the adjusting screw 42 in the threaded bore 54 of the metering rod 30 causes the rod to move upwardly or downwardly in the bore 40 of the slide member. This action vertically adjusts the metering rod relative to the slide member to thereby adjust idle or mid-range operation of the carburetor.

One of the drawbacks associated with these types of adjusting screw mechanisms is that the degree of adjustment or rotation of the screw 42 can be imprecise, such impression adversely affecting carburetor operation. For example, carburetor turning instructions may require a quarter or half turn of the adjusting screw for idle or mid-range adjustment. However, since it is difficult to visually observe the rotation of the adjusting screw 42 within the slide 22, the amount of rotational displacement of the adjusting screw 42 is usually visually monitored by rotation of the adjusting screw device such as a screwdriver or the like. Thus, a person tuning the carburetor may not precisely rotate the adjusting screw to the desired quarter or half turn.

In view of the drawbacks of the prior art design as discussed above, a need has developed to provide an improved adjusting screw mechanism which provides precise and accurate adjustments through rotation for improved carburetor performance.

Responsive to this need, the present invention provides an improved carburetor adjustment screw mechanism which provides an audible signal or a sensation to indicate the degree of rotational displacement of the adjusting screw for proper carburetor adjustment.

SUMMARY OF THE INVENTION

Accordingly, it is a first object of the present invention to provide an improved carburetor using a slide and metering rod adjustment mechanism.

Another object of the present invention is to provide a carburetor which produces an audible signal or a sensation to enable precise carburetor adjustment.

Other objects and advantages of the present invention will become apparent as a description thereof proceeds.

In satisfaction of the foregoing objects and advantages, the present invention provides an improvement in a carburetor having a body having an air inlet end, an air outlet end, a throttle extending therethrough from the inlet end to the outlet end, a fuel supply tube connected with the body and having communication with the throat, a throttle slide member movably mounted within the body intermediate the inlet and outlet ends thereof for substantially transverse movement across the throat to vary an unblocked portion thereof, a metering rod extending downwardly into the fuel supply tube to control the supply of fuel therethrough and means for adjusting the position of the metering rod as part of said throttle slide member, the adjusting means including an adjusting screw. The present invention, an improvement over this carburetor, includes a means for generating a signal, e.g. an audible sound or a sensation, in conjunction with the means for adjusting the position of the metering rod. Rotation of the adjusting means generates an audible sound, the sound corresponding to a predetermined rotational displacement of the screw to permit tuning of the carburetor based on the audible sound generation.

Preferably, the audible sound is generated every quarter revolution of the adjusting screw and includes a spring biased ball which clicks at each quarter revolution.

More preferably, the means for generating said signal further comprises:

(a) an externally threaded body having a first bore therethrough and a plurality of spaced apart second bores through the threaded body sidewall;

(b) an insert sized to engage the bore, the insert having a slot on one end, a threaded extension on the other end and a opening therein, the opening containing a spring biased ball;

(c) a clip ring sized to fit within the first bore to retain the insert in the first bore with the spring biased ball aligned to engage one of the second bores;

(d) a cylindrical pin actuator having an internally threaded bore sized to threadably attach to the threaded extension of the insert, the pin actuator having a pin extending outwardly from an outer surface thereof (e) the throttle slide member having a chamber therein, the chamber having a first internally threaded bore and step sized to threadably receive the externally threaded body against the step, the chamber having a second bore of smaller diameter than the internally threaded bore, the second bore having a longitudinal slot in an inner cylindrical surface thereof, the slot size to receive the pin of said cylindrical pin actuator; and (f) wherein rotation of the insert causes said spring biased ball to click when entering one of the second bores of the externally threaded body to generate the signal, rotation of the insert causing the cylindrical pin actuator to longitudinally translate to move the metering rod.

DESCRIPTION OF THE DRAWINGS

Reference is now made to the drawings accompanying the invention wherein:

FIG. 3 is an exploded side view of the metering rod adjustment assembly and slide member enlarged to show greater detail; FIG. 5 is a top view of the throttle slide member of the invention.

DETAILED DESCRIPTION OF THE PREFERRED EMBODIMENTS

The inventive carburetor makes it much easier to tune carburetors of the slide member and metering rod type, especially tuning from idle through full throttle. Using the metering rod adjusting assembly of the invention, accurate and precise adjustments to the air/fuel mixture are easily obtained.

Typically, the carburetor is preset by adjustment of the metering rod adjustment assembly to a desired air/fuel mixture. If an adjustment is to be made by merely rotating the adjustment screw, the screw can be turned clockwise to rich the mixture or counterclockwise to lean the mixture. Since the metering rod assembly generates a click for each quarter turn of the assembly insert, carburetor adjustment can be made by counting the number of clicks in a given direction.

For example, if the mixture is too rich, the mixture may be leaned by counterclockwise rotation for two clicks. Likewise, the mixture can be made more rich by clockwise rotation a given number of clicks.

With the clicking sound being made each quarter turn of the adjustment screw, a person tuning the carburetor can be assured of a precise and accurate adjustment to the air/fuel mixture. Adjustment by rotation of the assembly insert is particularly adapted for mixture adjustment from the idle to the mid-range operating conditions, typically 800 to 2500 RPM.

If mixture adjustment is required from mid-range to full throttle, typically, the metering rods are removed and replaced with a different sized rod.

Figure 1:
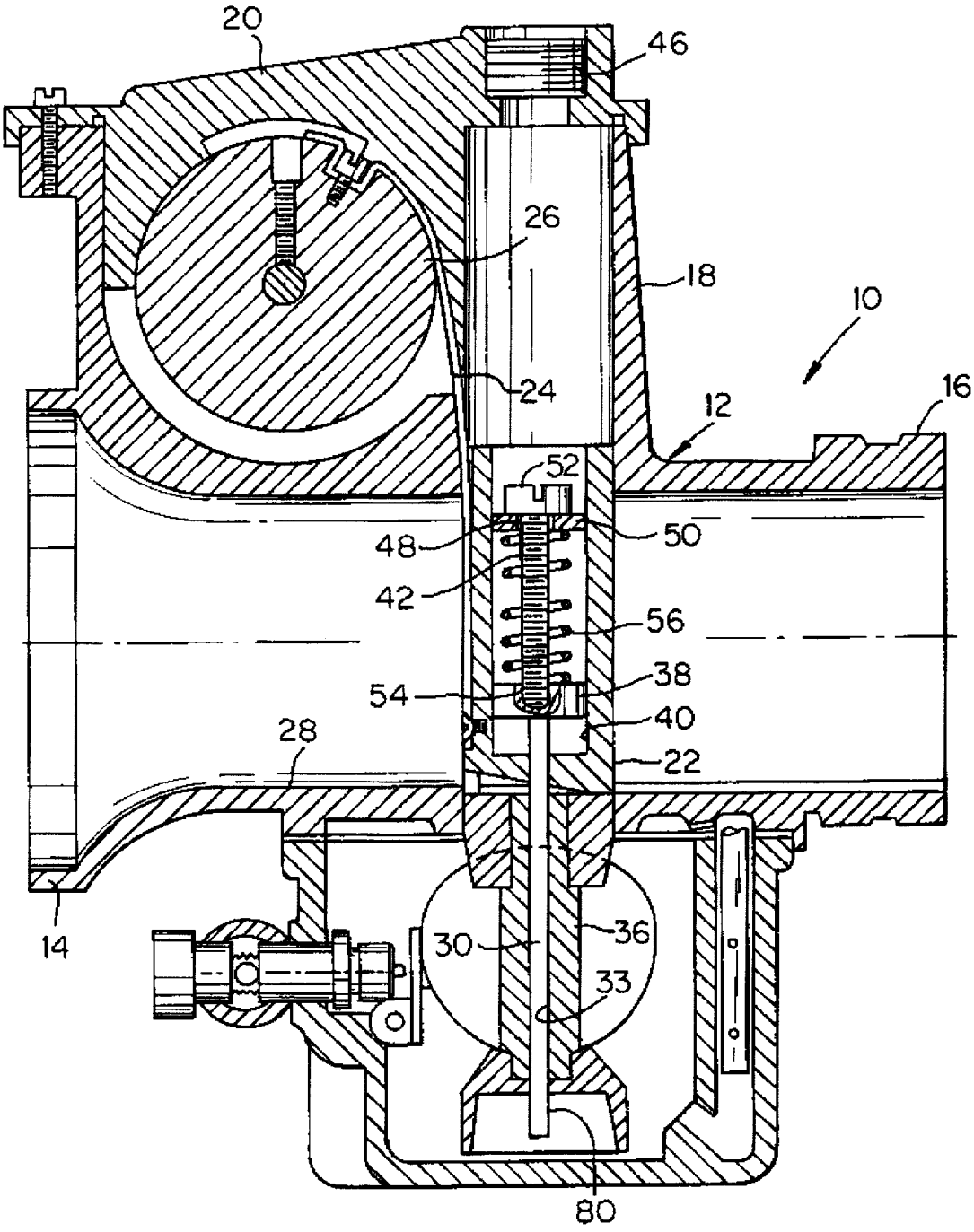
FIG. 1 (PRIOR ART)
FIG. 1 is a sectional view of a prior art carburetor utilizing a slide member and adjustment screw assembly.
Figure 2:
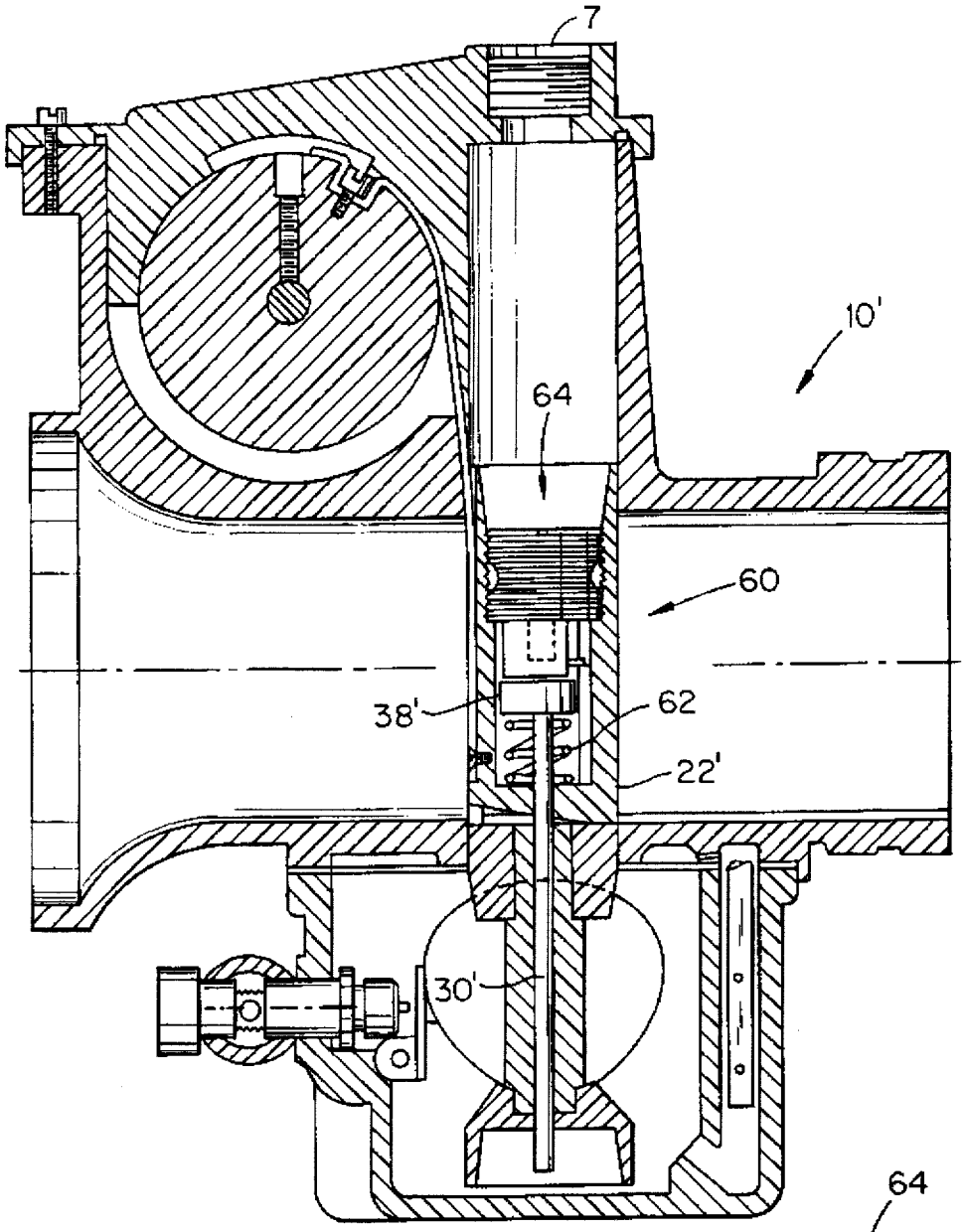
FIG. 2 is a sectional view of the carburetor according to the invention.

With reference now to FIG. 2, the carburetor is generally designated by the reference numeral 10' and is similar to that shown in FIG. 1 except for the slide 22' and metering rod assembly 60. The metering rod assembly 60 includes the metering rod 30', spring 62 and adjusting screw assembly 64. In operation, the metering rod head 38' is biased upwardly by action of the spring 62 against the adjusting screw assembly 64. The position of the metering rod 30 is adjusted upwardly or downwardly by rotation of an insert in the adjusting screw assembly 64 via the opening 44 as will be described in more detail hereinbelow.

Since many other features of the carburetor 10' and their functions are similar to those depicted in FIG. 1, a further detailed explanation of these features is not deemed necessary for understanding of the invention.

Figure 4:
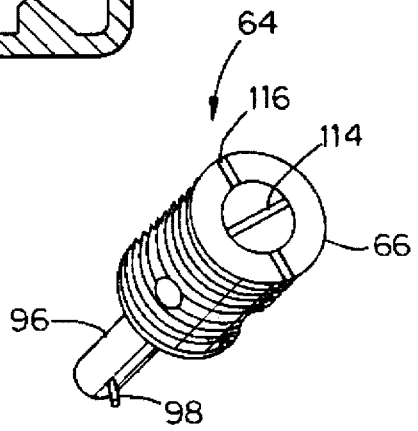
FIG. 4 is a perspective view of the adjusting screw assembly of the invention.

With reference now to FIGS. 3 and 4, the adjusting screw assembly 64 comprises an externally threaded body 66 having a bore 68 therein. An insert 70 is provided having an insert body 72 which engages the bore 68 such that the insert slotted end 74 is flush with the face 76 of the body 66. When engaged, the face 69 of the body 72 abuts the step 71 in the bore 68. The insert body 72 is freely rotatable in the bore 68.

The body 66 includes a plurality of bores 78 through the side walls thereof. Preferably, four bores are provided, adjacent bores spaced apart by 90°. In conjunction with the bores 78, a spring biased ball assembly 80 is provided made up of a spring 82, ball 84 and bore 86 in the insert body 72. The spring 82 biases the ball 84 outwardly, the ball 84 engaging one of the bores 78 in the body 66. Rotation of the insert 70 will result in a click every time the spring biased ball 84 is forced into one of the bores 78 in the body 66. By arranging the bores 78 in 90° spacings, each quarter revolution of the insert 70 will result in a clicking sound as well as a sensation which may be felt if the actual click cannot be heard due to engine noise or the like.

The insert also includes a externally threaded extension 88 and a retaining clip 90. The retaining clip 90 is sized to fit in a slot or step 92 in the bore 68 to retain the insert therein.

The threaded extension 88 is threaded onto the adjusting screw actuator body 94 via the complementary internally threaded bore 96. The adjusting screw actuator body 94 also includes a pin 98 situated in the bore 100. The pin 98 acts in conjunction with the slide 22' to prevent rotation of the actuator 94 and permit translation of the metering rod 30' as will be described hereinafter.

With reference to FIGS. 3 and 5, the slide 22' has a first bore 102 including a ramped side wall 104 and internally threaded portion 106. The internally threaded portion 106 is sized to threadably receive the body 66 for securement of the adjusting screw assembly 64 into the slide 22'. The externally threaded body 66 should tightly engage the threaded portion 106 so that only the insert 70 rotates during carburetor adjustment.

The slide 22' has a second chamber or bore 108 which has a slot 110 along a wall thereof. The slot 110 is sized to receive the pin 98 and prevent rotation of the needle actuator 94.

The metering rod 30' extends through the opening 112 in the bottom of the bore 108. The metering rod head 38' has a protrusion 101 sized to slide in slot 110 to prevent rotation thereof.

In operation, after the adjusting screw assembly 64 is engaged within the slide 22' along with the metering rod 30' and bias spring 62, a tool such as a screw driver is inserted into the slot 114 in the insert assembly, see FIG. 4. Since the body 66 is positively locked in the slide 22', only the insert 70 can freely rotate within the body 66. The adjusting screw actuator 94 is also non-rotatable due to the engagement between the pin 98 and slot 110. Likewise, the metering rod head 38' cannot rotate since the protrusion 101 engages slot 110.

Insert rotation will result in relative movement between the threaded extension 88 and internally threaded bore 96 of the adjustment screw actuator. Counterclockwise rotation of the insert results in an unscrewing motion of the threaded extension 88 out of the adjusting screw actuator 94. This unscrewing motion, since the insert 70 is fixed within the body 66, will result in a downward translation of the adjusting screw actuator 94 and downward movement of the metering rod 30'. Likewise, clockwise rotation of the insert 70 will result in a screwing in motion of the threaded extension 88 into the complementary threaded bore 96 of the adjusting screw actuator 94, this screwing in motion causing the adjusting screw actuator 94 to move upwardly with respect to the extension 88. This upward movement allows upward movement of the metering rod 30' due to the spring bias of the spring 62.

To facilitate attachment of the body 66 into the slide 22', the body 66 also has a slot 116 therein. During attachment of the body 66, the slot 114 in the insert 70 should be aligned with the slot 116 in the body 66 to permit use of a screw driver or other aligning tool. It should be understood that the slots 114 and 116 are merely exemplary modes to facilitate rotation of both the body 66 and the insert 70. Other configurations such as allen wrench heads or like can be utilized to facilitate rotation of either the body 66 or the insert 70.

The size of the threads on the threaded extension 88 can vary depending on the desired degree of upward or downward movement of the metering rod 30'. For example, the threaded extension 88 can be designed such that each quarter revolution of the insert 70 results in 1/32 of an inch of travel of the metering rod. Finer adjustments to the metering rod travel can be achieved by using a finer thread on the extension 88. Likewise, larger degrees of travel can be achieved by using coarser threads. Typically, 30 to 32 turns will cause the extension 88 to fully seat in the bore 96.

Although a spring-biased ball and bores are used to produce a click and/or sensation upon insert revolution, other sound-generating arrangements may be utilized in conjunction with the insert 70 to produce a desired signal, sound or sensation for carburetor tuning. For example, the externally threaded body 66 could have a spring-loaded ball or the like which would engage openings in the insert for sound generation. Likewise, other means for preventing rotation of the adjusting screw actuator can be utilized in substitution of the slot 110 arrangement as described above.

As such, an invention has been disclosed in terms of preferred embodiments thereof which fulfills each and every one of the objects of the present invention as set forth hereinabove and provides a new and improved carburetor.

Of course, various changes, modifications and alterations from the teachings of the present invention may be contemplated by those skilled in the art without departing from the intended spirit and scope thereof. Accordingly, it is intended that the present invention only to be limited by the terms of the appended claims.

I claim:

1. In a carburetor having:

a body having an air inlet end, an air outlet end, and a throat extending therethrough from said inlet end to said outlet end;

a fuel supply tube connected with said body and having an outlet in communication with said throat;

a throttle slide member movably mounted within said body intermediate said inlet and outlet ends thereof for substantially transverse movement across said throat to vary an unblocked portion thereof;

a metering rod extending downwardly into said fuel supply tube to control the supply of fuel therethrough; and means for adjusting the position of said metering rod as part of said throttle slide member, said means for adjusting including an adjusting screw, the improvement comprising said means for adjusting including means for generating a signal upon a rotation of said adjusting screw, said signal corresponding to a predetermined rotational displacement of said adjusting screw to permit tuning of said carburetor based on said signal generation;

said adjusting means comprising (a) an externally threaded body having a first bore therethrough and a plurality of spaced apart second bores through said threaded body sidewall;

(b) an insert sized to engage said first bore, said insert having a slot on one end, a threaded extension on the other end and an opening therein, said opening containing a spring biased ball;

(c) a clip ring sized to fit within said first bore to retain said insert in said first bore with sad spring biased ball aligned to engage one of said second bores;

(d) a cylindrical pin actuator having an internally threaded bore sized to threadably attach to said threaded extension of said insert, said pin actuator having a pin extending outwardly from an outer surface thereof;

(e) said throttle slide member having a chamber therein, said chamber having an internally threaded bore and step sized to threadably receive said externally threaded body against said step, said chamber having a second bore of smaller diameter than said internally threaded bore, said second bore having a longitudinal slot in an inner cylindrical surface thereof, said slot sized to receive said pin of said cylindrical pin actuator; and (f) wherein rotation of said insert causes said spring biased ball to click when entering one of said second bores of said externally threaded body to generate said signal, rotation of said insert causing said cylindrical pin actuator to longitudinally translate to move the metering rod.

2. The carburetor of claim 1 wherein said second bores in said externally threaded body are spaced apart in 90° intervals.

3. The carburetor of claim 1 wherein the threads of said threaded extension are sized such that a 90° rotation of said insert causes said cylindrical pin actuator to travel 1/32 of an inch.

* * * * *